United States Patent [19]

Baron et al.

[11] 4,449,305

[45] May 22, 1984

[54] FREEZE-DRYING APPARATUS

[75] Inventors: Michel Baron, Plaisir; Philippe Larrat, Beynes, both of France

[73] Assignee: Societe d'Utilisation Scientifique et Industrielle du Froid Usifroid, Maurepas, France

[21] Appl. No.: 389,405

[22] Filed: Jun. 17, 1982

[30] Foreign Application Priority Data

Jul. 1, 1981 [FR] France ..... 81 12926

[51] Int. Cl.[3] ..... F26B 13/30; F26B 5/06

[52] U.S. Cl. ..... 34/92; 34/5

[58] Field of Search ..... 34/5, 92

[56] References Cited

U.S. PATENT DOCUMENTS

| | | | |
|---|---|---|---|
| 3,242,575 | 3/1966 | Manaresi | 34/92 |
| 3,354,609 | 11/1967 | Nerge et al. | 34/92 |
| 3,667,135 | 6/1972 | Rowell | 34/92 |
| 3,740,860 | 6/1973 | Smith, Jr. | 34/92 |

FOREIGN PATENT DOCUMENTS

| | | |
|---|---|---|
| 1398067 | 3/1965 | France . |
| 1415793 | 9/1965 | France . |
| 2198611 | 3/1974 | France . |

*Primary Examiner*—John J. Camby

*Attorney, Agent, or Firm*—Lee C. Robinson, Jr.

[57] ABSTRACT

Apparatus for freeze-drying products comprises an enclosure within which are mounted shelves provided with cooling and heating means and in which vessels for containing the products are located.

These shelves are arranged in two series, viz a first series maintained at a temperature lower than 0° C. and a second series maintained at a temperature higher than 0° C. in operation and a transfer mechanism is incorporated to cause the vessels to travel from the shelves of the first series to those of the second series, the enclosure being under vacuum.

The invention is applicable for the freeze-drying of food products, biological substances, among others.

8 Claims, 5 Drawing Figures

II
12a
12
17
10
16
15
31
33a
21
413
411
430
51
50
B
23a
415
410
11
41
42
420
11a
32
30
22
20

FREEZE-DRYING APPARATUS

BACKGROUND OF THE INVENTION

The present invention relates to apparatus for freeze-drying products, of the kind comprising an enclosure within which are placed superposed shelves provided with cooling and heating means and carrying vessels for containing the said products.

It is known that freeze-drying is a method for eliminating water from the structure of organic or inorganic substances, in particular from products of the nutritional and pharmaceutical types among others, and which essentially consists in a freezing operation followed by a sublimating operation under vacuum.

Freeze-drying apparatus known at present comprise either two separate enclosures one of which is utilised for freezing and the other for sublimation, the latter being evacuable, or a single enclosure in which the two freezing and sublimating operations are performed consecutively and which may be placed under vacuum for this second operation.

Although apparatus of this second kind forms an obvious simplification compared to the first by reducing bulk and control operations, it still has grave disadvantages: the shelves must be chilled and heated alternately to produce freezing and sublimation. This leads to a substantial power wastage as well as to an appreciable loss of time, since it is necessary to wait for the temperature inversion to have taken place within the shelves.

SUMMARY OF THE INVENTION

It is an object of the present invention to minimise or eliminate the disadvantages hereinabove referred to and to this end it proposes freeze-drying apparatus in which the shelves in the enclosure are formed by two separate series, i.e. a first series kept at a temperature lower than 0° C. and a second series kept at a temperature higher than 0° C. in operation, and which comprises a transfer mechanism arranged to cause the vessels to travel from the shelves of the first series to those of the second series, the enclosure being under vacuum.

Each series of shelves thus remains, in operation, at a constant or substantially constant temperature, for example −40° C. for the first series and +40° C. for the second series, which eliminates power and time wastages, the transfer mechanism rendering it possible to perform the freezing and sublimating operations consecutively by assuring the displacement of the vessels.

In one embodiment of the invention, the shelves of one series are co-planar with the shelves of the other series and the aforesaid transfer mechanism is arranged for entrainment of the vessels whilst causing these to slide from one shelf to another. This arrangement ensures very uncomplicated configuration and a very reliable operation of the apparatus.

Advantageously, the enclosure is provided with an array of withdrawable flaps forming a heat barrier, said flaps being located between said first and second series of shelves.

This array of withdrawable flaps stops radiation and convention between the two series of shelves and thus assures a higher thermal efficiency of the apparatus whilst allowing of unimpeded sliding of the vessels.

BRIEF DESCRIPTION OF THE DRAWINGS

In order that the invention may be more clearly understood, reference will now be made to the accompanying drawings which show one embodiment thereof by way of non-limiting example and in which.

DETAILED DESCRIPTION OF PREFERRED EMBODIMENT

Figure 1:
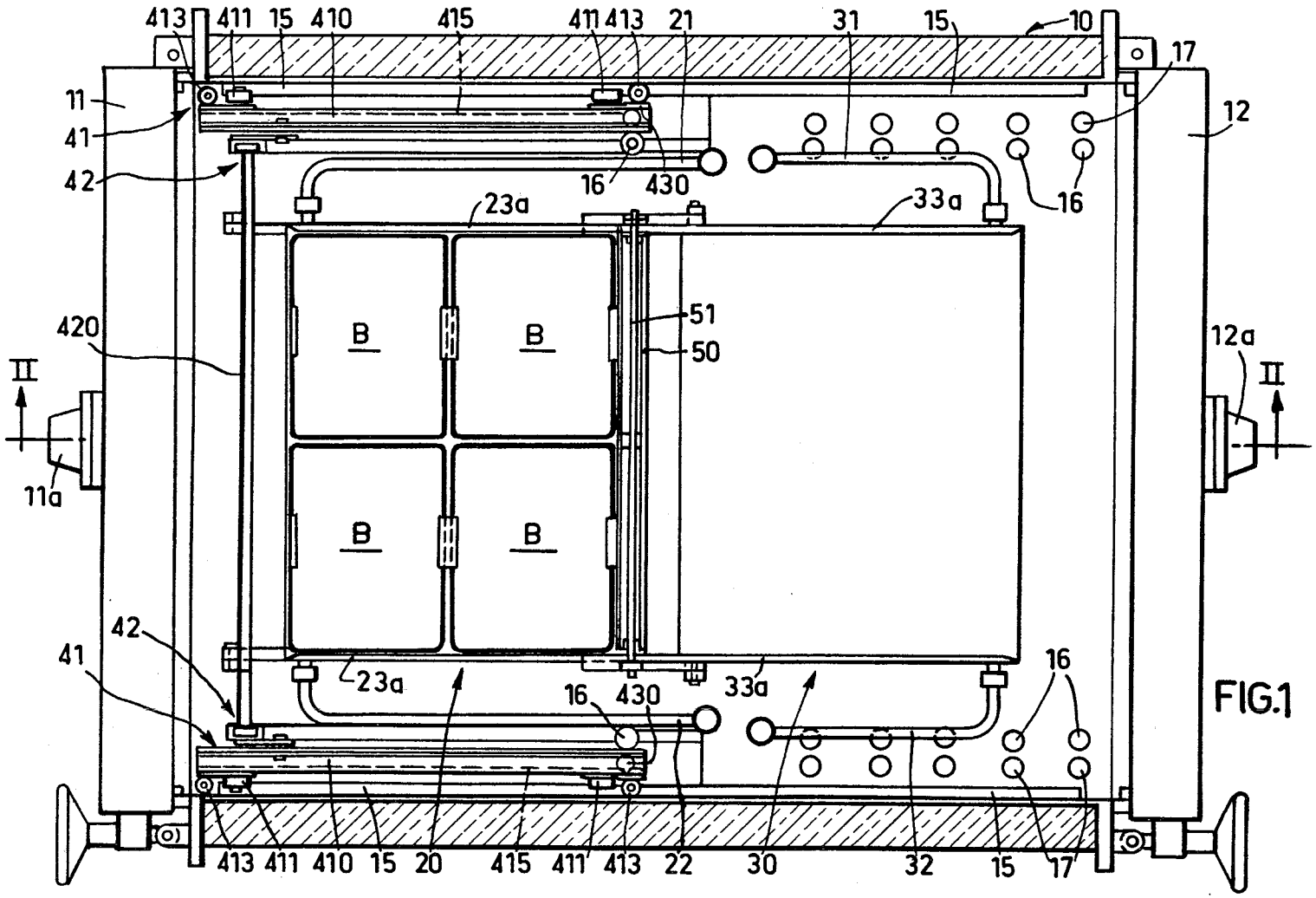
FIG. 1 is an illustration in diagrammatical manner and in plan view of the apparatus, the upper side of the enclosure being assumed to have been removed.

Referring now to the drawings, the embodiment illustrated therein essentially comprises an enclosure or vat 10 of generally rectangular shape, arranged to be placed under vacuum by a pump P and closed off at its two opposed extremities by doors 11, 12, provided with port-holes or windows 11*a*, 12*a* respectively, allowing a visual check of the products to be made during processing. Within the enclosure 10 are located two series of shelves or superposed panels 20 and 30 intended to receive vessels B for containing the products which are to be freeze-dried, as well as a transfer mechanism 40 for causing the vessels B to travel from the shelves of the series 20 to those of the series 30.

The superposed shelves 20*a*, 20*b*, 20*c* . . . and 30*a*, 30*b*, 30*c* . . . of the series 20 and 30 respectively are provided with known chilling and heating means, for example formed by coils (not illustrated) which respectively convey a flow of refrigerating fluid and a flow of heating fluid. The piping between these coils and the required sources or refrigerating and heating sources (not illustrated) have been shown at 21, 22 and 31, 32. The shelves 20*a*, 20*b*, 20*c* . . . , and 30*a*, 30*b*, 30*c*, are moreover provided with lateral flanges 23*a*, 23*b*, 23*c* and 33*a*, 33*b*, 33*c* . . . respectively, allowing the vessels B to be guided during their translatory displacement.

The temperatures of the refrigerating and heating fluids should be lower and higher than 0° C. respectively, in such manner as to allow of freezing aqueous substances contained in the products which are to be freeze-dried, followed by the sublimation under vacuum of these aqueous substances. These temperatures may for example be −40° C. and +40° C.

Furthermore, each shelf 20*a*, 20*b*, 20*c* . . . of the series of chilled shelves 20 is co-planar with a shelf 30*a*, 30*b*, 30*c* . . . of the series of heated shelves 30.

The transfer mechanism denoted as a whole by 40, comprises a frame 41 which is translatorily displaceable in both directions within the enclosure 10 and on which is articulated an element for exerting a thrust on the vessels 42 and a mechanism 43 for entraining the said frame in translatory displacement.

The frame 41 is formed by two identical lateral cheek plates 410 provided with supporting rollers 411 which roll on horizontal rails 15 secured on the internal surfaces of the enclosure 10 and with thrust rollers 413 bearing against the sidewalls of the said enclosure. The cheek plates 410 are also provided with racks 415 for translatory entrainment of the frame 41.

Figure 2:
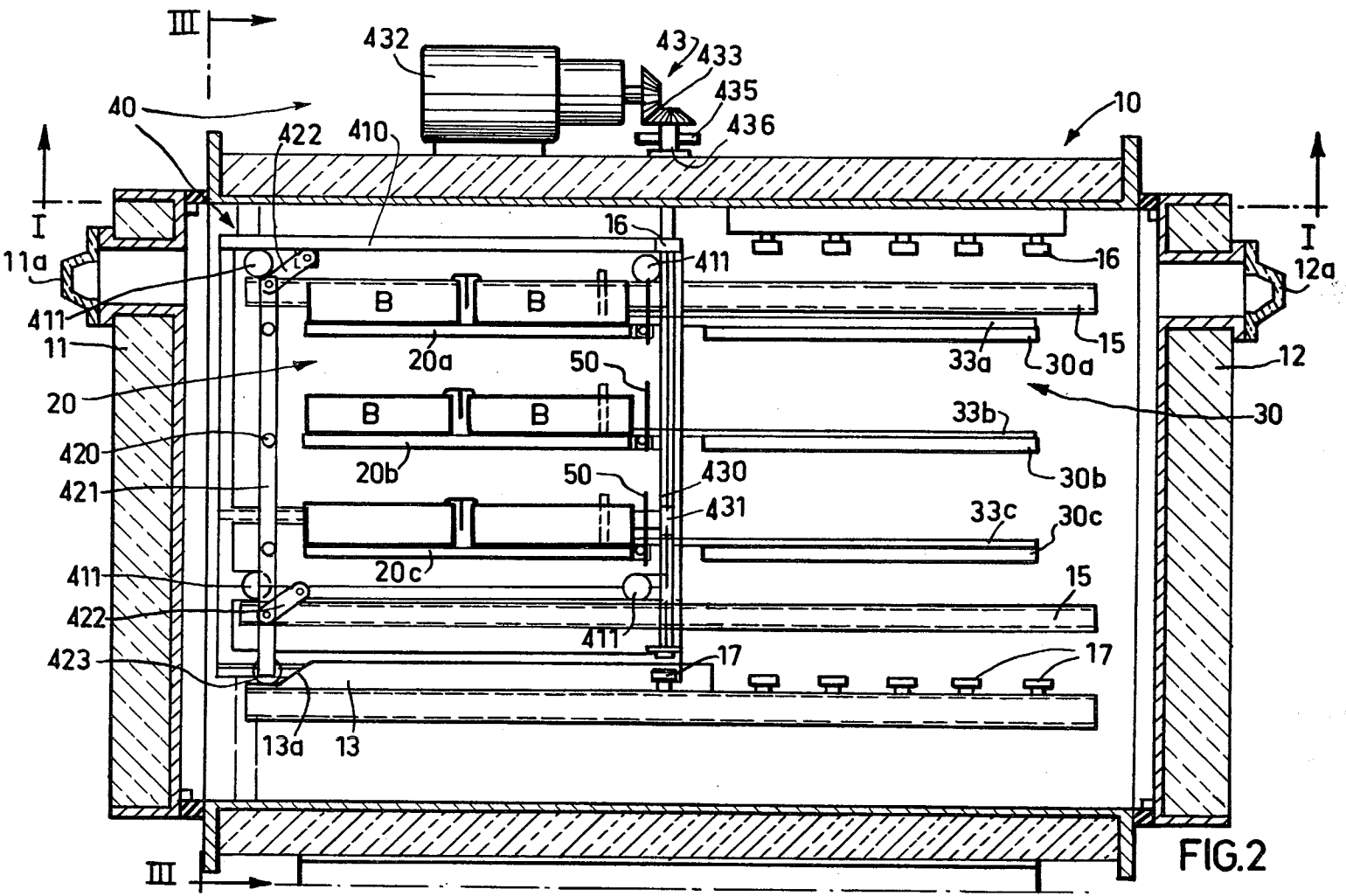
FIG. 2 is a cross-section along the line II—II of FIG. 1.
Figure 3:
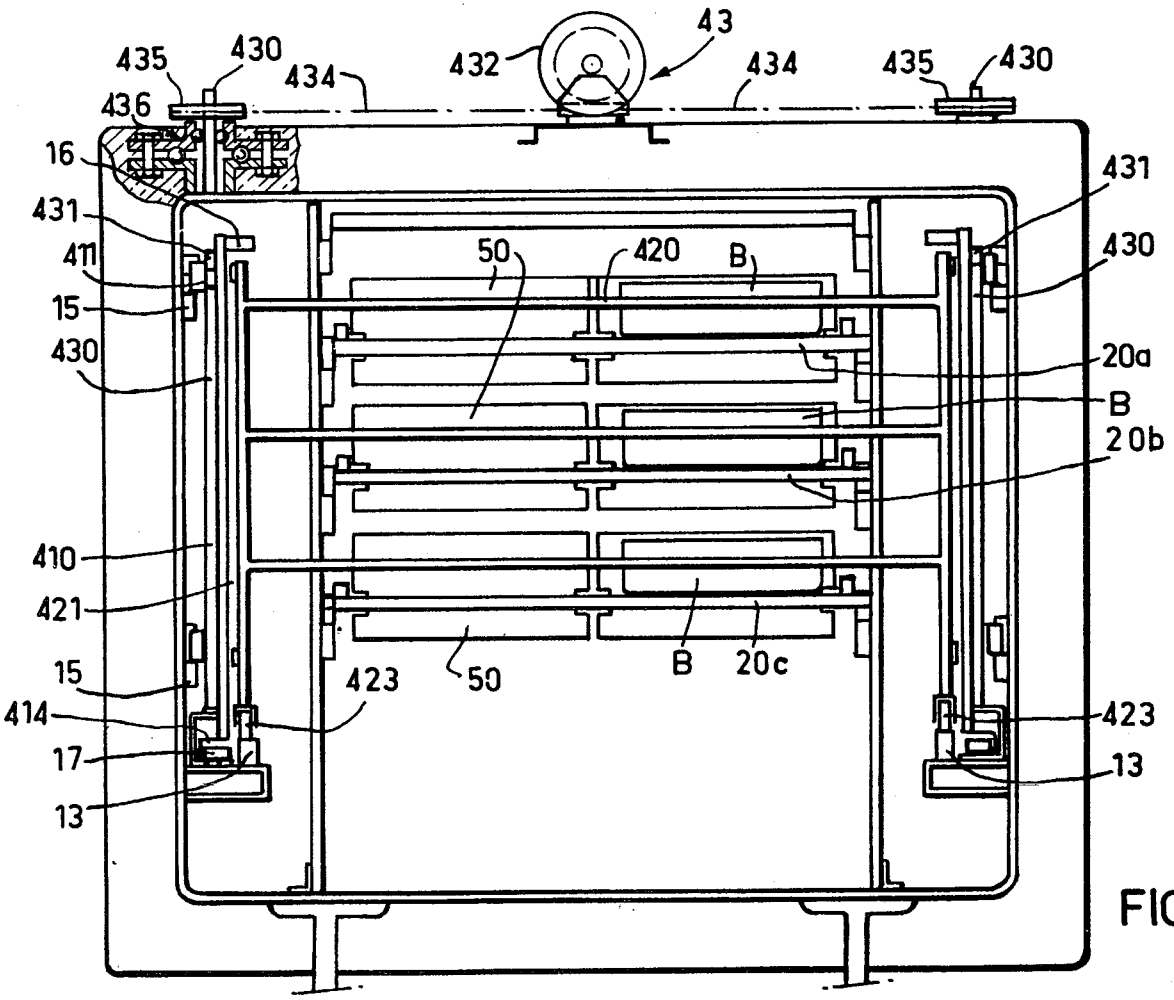
FIG. 3 is a cross-section along the line III—III of FIG. 2 with partial removal of the wall of the enclosure.
Figure 4:
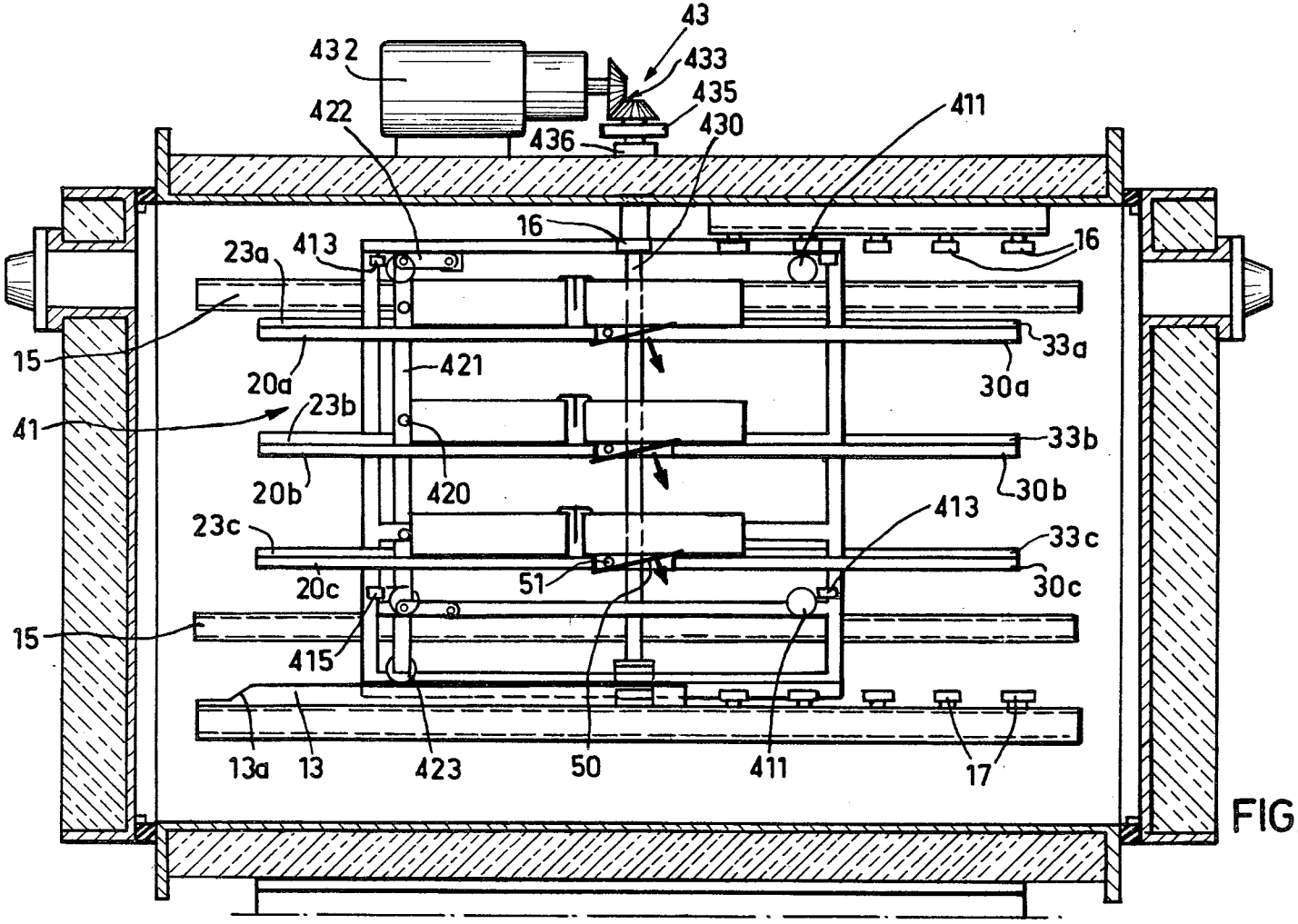
FIG. 4 is a view identical to FIG. 2 but showing the transfer mechanism whilst entraining vessels.
Figure 5:
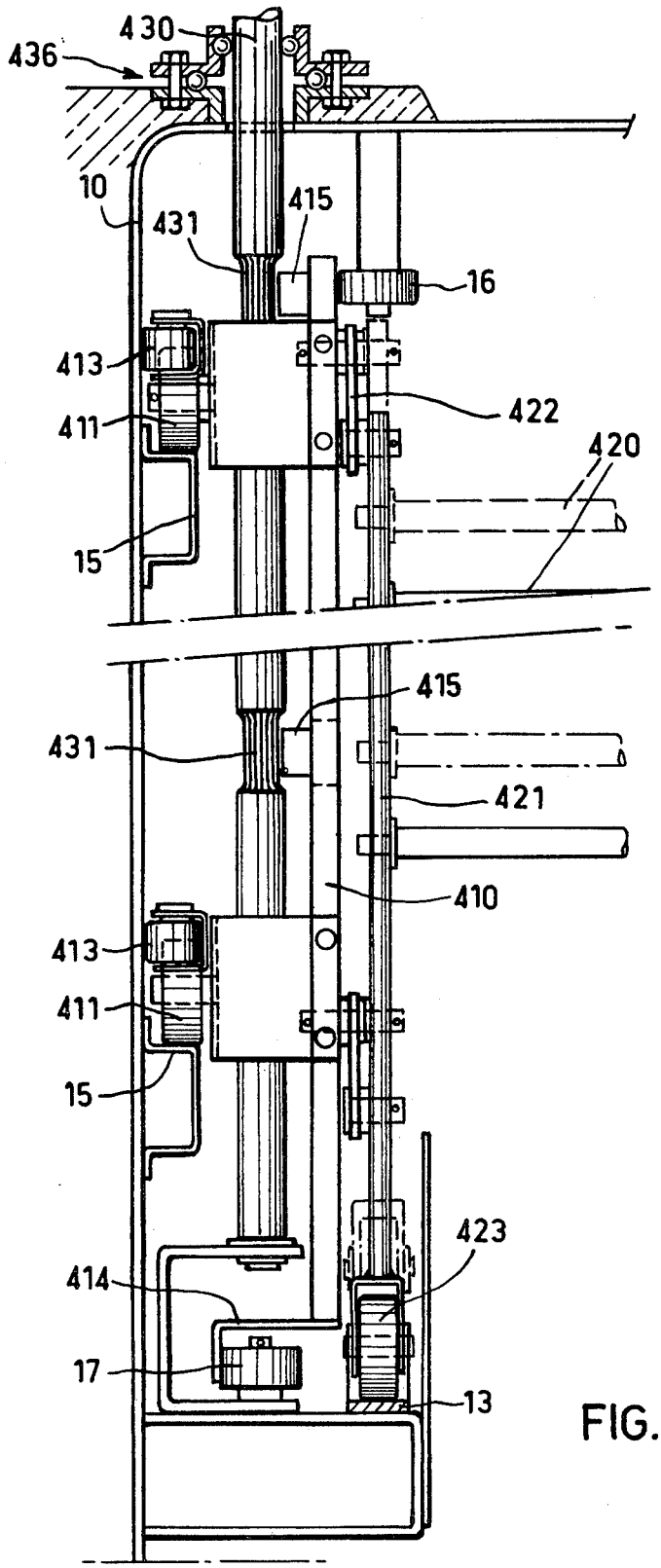
FIG. 5 is an enlarged scale illustration of the guiding and entraining particulars of the transfer mechanism.

The element for exerting thrust against the vessels 42 comprises a set of horizontal bars 420 secured on two uprights 421 coupled to the frame 41 via connecting rods 422. At its loweer part, each upright 421 is provided with a roller 423 co-operating with a fixed ramp or cam 13 installed on the enclosure. The outline of the sloping surface 13 is devised to operate the positioning of the element 42 with respect to the frame 41, in such manner that the bars 420 occupy either a low position allowing the vessels B to be placed in position on the shelves 20*a*, 20*b*, etc . . . (FIG. 2 and solid lines of FIG. 5), or a high position such as to engage the said vessels B and entrain these in translatory displacement from the shelves of series 20 to those of series 30 (FIG. 4 and dotted lines of FIG. 5). The sloping surface 13 has a highly sloping portion 13*a* close to its left-hand end (looking at FIG. 2) for this purpose.

The mechanism 43 for translatory displacement of the frame 41 comprises two shafts 430 mounted vertically and rotatably in the enclosure 10, each shaft 430 being provided with two series of splines 431 arranged to mesh with the racks 415 installed on the two lateral cheek plates 410 of the said frame 41 (see FIG. 5). The rotation of each shaft 430 is effected by a single electric motor 432 located outside the enclosure, via a pair of bevel gears 433, a transmission of any known kind shown at 434 and arranged so that the two shafts 430 rotate synchronously and in opposed directions, and a pinion 435 keyed on the upper part of the shaft 430 which passes through the wall of the enclosure 10. A joint 436 ensuring sealing under vacuum is incorporated for this purpose.

Within the enclosure 10 and affixed thereto, are mounted upper and lower guiding rollers 16 and 17, respectively, which assure a rectilinear displacement of the frame 41 whilst opposing the lateral thrust exerted on the frame at the level of the racks. The rollers 16 bear against the inner surfaces of the upper portion of the cheek plates 410 whereas the rollers 17 bear against angles 414 secured to the lower portion of the cheek plates 410.

Between the two series of shelves 20 and 30 is situated an array of retractable (or otherwise withdrawable) flaps 50 rotatably mounted on spindles 51. Due to a counterweight or spring (not illustrated) these flaps 50 normally occupy a vertical position, but assume a horizontal position under the action of a thrust exerted either by the vessels when these travel from the shelves 20 to the shelves 30, or by the bars during the oppositely directed displacement of the frame 41.

The apparatus operates in the following manner: after the preset subzero temperature has been established in the shelves 20, the vessels B are placed in position on the shelves either manually or automatically to accomplish the freezing of the products. As soon as this freezing temperature is established, the enclosure is placed under vacuum, and the sublimating operation is performed by causing the vessels B to travel from the chilled panels 20 to the hot panels 30. To this end, the motor 432 is started, which acts via the shafts 430, entrains the frame 41 in translatory displacement from the left towards the right, looking at FIGS. 2 and 4. The vessel thrust element 42 then passes to a high position, so that each of the bars 420 comes into contact with a vessel and entrains the latter translatorily as well as those preceding the same, if applicable. Each flap 50 is pushed aside as soon as it is struck by a vessel and does not regain its initial vertical position until after the said vessel or vessels has or have passed. The vessels then being in position on the shelves 30, the heating fluid is caused to flow until the sublimation stage is completed. The vessels and the products they carry may thereupon be discharges via the outlet door 12. By causing the motor 432 to rotate in the opposed direction, the frame 41 is returned to its initial position from the left towards the right, the bars 420 pushing the flaps 50 aside whilst passing through.

Numerous modifications may be made to the details of the embodiment described and illustrated without in any way departing from the scope of the invention as defined by the appended claims.

We claim:

1. Apparatus for freeze-drying products contained in vessels, the apparatus comprising:
   - an enclosure defining a single compartment;
   - a plurality of freezing shelves and heating shelves housed within said enclosure and arranged in two separate groups;
   - cooling means thermally coupled to said freezing shelves to maintain said freezing shelves at a temperature below 0° C. during operation of said freeze-drying apparatus;
   - heating means thermally coupled to said heating shelves to maintain said heating shelves at a temperature above 0° C. during operation of said freeze-drying apparatus;
   - means for transferring the vessels containing the products to be freeze-dried from the freezing shelves to the heating shelves; and
   - means for selectively creating a vacuum in said single compartment.

2. Apparatus according to claim 1, wherein each of the freezing shelves is co-planar with a respective one of the heating shelves and said means for transferring the vessels containing the products to be freeze-dried includes means for slidably moving the vessels from the freezing shelves to the heating shelves.

3. Apparatus according to claim 2, wherein said enclosure further includes an array of withdrawable flaps, the flaps of said array being located between the freezing shelves and the heating shelves such that each of the flaps forms a heat barrier.

4. Apparatus according to claim 2, wherein said means for slidably moving the vessels containing the products to be freeze-dried includes a frame translatorily displaceable within said enclosure, a vessel-thrusting device mounted to said frame and an entraining mechanism mounted to the enclosure for translatorily displacing said frame.

5. Apparatus according to claim 4, wherein said enclosure further includes at least two substantially horizontal rails, the rails being mounted to the inside surfaces of corresponding opposite walls of said enclosure; and wherein said frame includes at least two lateral cheek plates mounted thereon, at least one pair of running rollers, each of which is mounted to a respective cheek plate and displaceable on a respective horizontal rail of said enclosure, and at least one pair of thrust rollers, each of the thrust rollers being mounted to a respective cheek plate and cooperating with a respective wall of said enclosure.

6. Apparatus according to claim 4, wherein said enclosure further includes a cam mounted thereon; and wherein said vessel-thrusting device includes at least one roller engageably cooperating with said cam of the enclosure, and a set of horizontal bars articulated on said frame and vertically displaceable with respect to said frame, said set of horizontal bars being coupled to the roller and the roller cooperating with said cam to control the position of the horizontal bars with respect to said frame.

7. Apparatus according to claim 5, wherein at least one of the cheek plates includes a rack mounted thereon; and wherein said entraining mechanism includes at least one shaft rotatably and vertically mounted in said enclosure, the shaft having meshing means engageably cooperating with the rack of one of the cheek plates, the shaft being rotatably driven by a motor located outside said enclosure.

8. Apparatus for freeze-drying products contained in vessels, the apparatus comprising:

an enclosure defining a single compartment, said enclosure including a vessel entry door and a vessel exit door;

a plurality of freezing shelves and heating shelves housed within said enclosure and arranged in two separate groups, each of said freezing shelves being co-planar with a respective one of said heating shelves;

cooling means thermally coupled to said freezing shelves to maintain said freezing shelves at a temperature below 0° C. during operation of said freeze-drying apparatus;

heating means thermally coupled to said heating shelves to maintain said heating shelves at a temperature above 0° C. during operation of said freeze-drying apparatus;

means for transferring the vessels containing the products to be freeze-dried from the freezing shelves to the heating shelves, said vessel transferring means including means for slidably moving the vessels from the freezing shelves to the heating shelves; and means for selectively creating a vacuum in said single compartment.

* * * * *